US009545791B2

(12) United States Patent
Oonuki et al.

(10) Patent No.: US 9,545,791 B2
(45) Date of Patent: Jan. 17, 2017

(54) INK JET PRINTING APPARATUS AND PRINT HEAD TEMPERATURE CONTROL METHOD

(71) Applicant: CANON KABUSHIKI KAISHA, Tokyo (JP)

(72) Inventors: Kenichi Oonuki, Kawasaki (JP); Hidehiko Kanda, Yokohama (JP); Akiko Aichi, Tokyo (JP); Hirokazu Yoshikawa, Yokohama (JP); Hiroshi Taira, Chofu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/311,560

(22) Filed: Jun. 23, 2014

(65) Prior Publication Data

US 2014/0300661 A1 Oct. 9, 2014

Related U.S. Application Data

(62) Division of application No. 13/896,366, filed on Oct. 1, 2010, now Pat. No. 8,888,223.

(30) Foreign Application Priority Data

Oct. 9, 2009 (JP) ..... 2009-235329

(51) Int. Cl.
*B41J 29/393* (2006.01)
*B41J 2/045* (2006.01)
*B41J 2/07* (2006.01)

(52) U.S. Cl.
CPC ..... *B41J 2/04563* (2013.01); *B41J 2/0454* (2013.01); *B41J 2/0458* (2013.01); *B41J 2/072* (2013.01)

(58) Field of Classification Search
CPC ..... B41J 2/04563
See application file for complete search history.

(56) References Cited

U.S. PATENT DOCUMENTS

| | | | |
|---|---|---|---|
| 5,361,090 | A | 11/1994 | Suzuki et al. |
| 5,576,746 | A | 11/1996 | Suzuki et al. |
| 5,825,377 | A | 10/1998 | Gotoh et al. |
| 5,838,340 | A | 11/1998 | Shimoda |

(Continued)

FOREIGN PATENT DOCUMENTS

| | | | |
|---|---|---|---|
| JP | 04-193537 | A | 7/1992 |
| JP | 08-039807 | A | 2/1996 |
| JP | 2006-076223 | A | 3/2006 |

OTHER PUBLICATIONS

Office Action mailed May 14, 2013, in Japanese Patent Application No. 2009-235329, Japanese Patent Office.

*Primary Examiner* — Julian Huffman
(74) *Attorney, Agent, or Firm* — Fitzpatrick, Cella, Harper & Scinto

(57) ABSTRACT

When the head temperature Tfinish, which is the head temperature at the time of completion of a preceding scan, is higher than the stable ejection temperature Tstable, the target temperature is made a temperature that is only a temperature value ΔT lower than the head temperature Tfinish. On the other hand, when Tfinish, the head temperature at the time of print completion, is lower than the stable ejection temperature Tstable, the target temperature is made a temperature that is only a temperature value ΔT higher than the head temperature Tfinish. Because of this it is possible to inhibit head temperature rise in the case where an image with a high print density is printed.

15 Claims, 12 Drawing Sheets

(56) References Cited

U.S. PATENT DOCUMENTS

| | | | |
|---|---|---|---|
| 5,949,447 | A | 9/1999 | Arai et al. |
| 6,027,196 | A | 2/2000 | Gotoh et al. |
| 6,109,720 | A | 8/2000 | Gotoh et al. |
| 6,113,210 | A | 9/2000 | Gotoh et al. |
| 6,244,681 | B1 | 6/2001 | Yano et al. |
| 6,260,938 | B1 | 7/2001 | Ohtsuka et al. |
| 6,543,872 | B2 | 4/2003 | Ohtsuka et al. |
| 6,712,443 | B2 | 3/2004 | Kanda et al. |
| 6,857,718 | B2 | 2/2005 | Moriyama et al. |
| 6,913,337 | B2 | 7/2005 | Kuronuma et al. |
| 6,921,218 | B2 | 7/2005 | Moriyama et al. |
| 6,957,879 | B2 | 10/2005 | Moriyama et al. |
| 6,991,316 | B2 | 1/2006 | Maru et al. |
| 7,080,892 | B2 | 7/2006 | Moriyama et al. |
| 7,101,010 | B2 | 9/2006 | Holstun et al. |
| 7,185,964 | B2 | 3/2007 | Kanda et al. |
| 7,290,855 | B2 | 11/2007 | Chikuma et al. |
| 7,296,872 | B2 | 11/2007 | Hayashi et al. |
| 7,296,877 | B2 | 11/2007 | Chikuma et al. |
| 7,315,393 | B2 | 1/2008 | Kanda et al. |
| 7,651,194 | B2 | 1/2010 | Yazawa et al. |
| 7,706,023 | B2 | 4/2010 | Kanda et al. |
| 7,722,143 | B2 | 5/2010 | Yoshikawa et al. |
| 7,748,809 | B2 | 7/2010 | Takahashi et al. |
| 7,758,153 | B2 | 7/2010 | Tanaka et al. |
| 7,762,640 | B2 | 7/2010 | Kanda et al. |
| 7,782,350 | B2 | 8/2010 | Tanaka et al. |
| 7,798,601 | B2 | 9/2010 | Yoshikawa et al. |
| 2008/0284823 | A1 | 11/2008 | Moriyama et al. |
| 2009/0015638 | A1 | 1/2009 | Umezawa et al. |
| 2010/0156981 | A1 | 6/2010 | Chikuma et al. |
| 2010/0321436 | A1 | 12/2010 | Nakano et al. |

INK JET PRINTING APPARATUS AND PRINT HEAD TEMPERATURE CONTROL METHOD

This application is a divisional of U.S. patent application Ser. No. 12/896,366, filed Oct. 1, 2010, which is now allowed.

BACKGROUND OF THE INVENTION

Field of the Invention

The present invention relates to an ink jet printing apparatus and method for controlling print head temperature, and particularly to a configuration for controlling the temperature of ink ejecting print heads, i.e. the temperature of ejected ink.

Description of the Related Art

Traditionally, control of the temperature of the ink in the print head has been carried out to control the variation of the volume of an ejected ink drop with respect to ink jet printing apparatuses. This can inhibit the occurrence of density variation in printed images. On the other hand, the temperature of the ink in the print head (also simply referred to herein as the temperature of the print head or the head temperature) changes in accordance with the ejection frequency of the ink and the ejection rest interval. For example, when an interruption of the printing operation (for example, a recovery operation or waiting for print data transmission) occurs during the printing operation, the temperature of the print head drops and a striking difference in the print density before and after the print interruption occurs.

As a configuration for the prevention of density variation in images caused by this kind of print head temperature variation, it is disclosed in Japanese Patent Application Laid-Open No. H08-039807 (1996) that the difference between a stable ejection temperature, which is set in advance and is the temperature at which print head ejection is stable, and the actual temperature of the print head is obtained, and that the print head temperature is controlled in response to this difference. More concretely, it is disclosed that when the difference is such that the stable ejection temperature is higher and is positive difference, heating is carried out, and conversely the non-print operation time is extended when there is a large negative difference.

It is also disclosed in Japanese Patent Application Laid-Open No. H04-193537 (1992) that when restarting a printing operation after an interruption the head temperature is controlled such that it becomes roughly the same temperature as at the time of interrupting the printing operation.

However, problems such as those described below often arise in the prior art temperature controls described in the above two publications. As for Japanese Patent Application Laid-Open No. H04-193537 (1992), when a scan of the print head is completed and the printing operation is interrupted, the head temperature at the time of completion becomes the target temperature of the temperature control at the time of the next printing. Therefore, for example, when the head temperature rises due to a scan in which high density images are printed, that is, images with a high ejection frequency, control is carried out with the raised temperature at the time of scan completion as the target and as such the head temperature is prone to reach a higher temperature.

FIG. 12A is a diagram that, at times when there are printing interruptions due to, for example, print data transmission waiting time, illustrates head temperature variation versus the passage of time, during the printing of an image with a comparatively high density, in connection with the temperature control described in Japanese Patent Application Laid-Open No. H04-193537 (1992). In the case where a high density image is printed, the ejection frequency of the print head has thereby increased and thus the temperature rise of the print head becomes larger. Because of this, in the example shown in the same figure, the head temperature rises to approximately 50° C. in the first three times of printing operations (scans). Subsequently, when there is a print interruption due to, for example, print data transmission waiting time, the head temperature has a relatively large decrease due to the cessation of the ejection operation. Thus, in the subsequent head temperature control, heating is carried out with 50° C., the head temperature at the time of interrupting printing operation (the time at the completion of the immediately preceding scan), as the target temperature, and printing is restarted. In this printing as well, when the print density is high, the head temperature rises in the restarted scan as well. In this manner, in the case where the density of the printed image is high, the above described temperature change repeats and as a result the head temperature increasingly elevates.

Also, as for Japanese Patent Application Laid-Open No. H08-039807 (1996), in the case where the head temperature at the time of scan completion is lower than the predetermined stable ejection temperature, heating occurs before the next scan until the stable ejection temperature is reached. Therefore, in the case where density of an image to be printed is low and thus the head temperature is lowered a comparatively large amount during scan, the difference between the lowered head temperature at the time when the scan is completed and the head temperature at the start of the next scan, which is obtained by heating the print head to the stable ejection temperature, becomes large, and a large density difference occurs between the images of the scans.

FIG. 12B is a diagram that illustrates the head temperature variation when a low density image is printed while the head temperature control described in Japanese Patent Application Laid-Open No. H08-039807 (1996) is carried out. In this example the stable ejection temperature is 40° C. The head temperature, which has risen to the stable ejection temperature of 40° C., decreases due to the printing of a low density image, that is, the printing of an image with a low ejection frequency. In the example shown in FIG. 12B, in one scan it drops 8° C. from approximately 40° C. to 32° C. After the first scan has been completed, the head temperature is again heated to 40° C., which is the stable ejection temperature, before the next scan. As a result the difference between the head temperature at the time the scan is completed (32° C.) and the head temperature at the time that the next print scan is commenced, that is, the stable ejection temperature (40° C.), becomes a relatively large 8° C. Accordingly, density variation occurs as the result of the head temperature difference at each scan.

On the other hand, in the head temperature control of Japanese Patent Application Laid-Open No. H08-039807 (1996), when the head temperature at the time of scan completion is higher than the predetermined stable ejection temperature, density variation also occurs in the same manner. That is, in the case where the head temperature at the time a scan has been completed is higher than the stable ejection temperature, the non-print operation time is extended in order to decrease the head temperature. Therefore, also in the case where the print density is high the difference between the head temperature at the time of scan start and the head temperature at the time of scan completion is large, and density variation in the image is prone to occur.

FIG. 12C is a diagram that illustrates head temperature variation in Japanese Patent Application Laid-Open No. H08-039807 (1996) when an image with a high print density is printed. The ejection frequency increases due to the printing of an image with a high print density, and such scan raises the head temperature. In the example shown in FIG. 12C head temperature rises 8° C. in one scan. Because the head temperature at the time that a scan is completed (48° C.) is higher than the stable ejection temperature, the non-print operation time after the scan is extended and printing is paused until the head temperature drops to 40° C. Accordingly, the difference between the head temperature at the time of scan completion (48° C.) and the head temperature at the time of start of the next scan (40° C.) becomes relatively large, and density variation becomes prone to occur due to the head temperature difference.

As explained above, the prior art head temperature controls, so to speak, are such that a predetermined temperature, i.e. the stable ejection temperature, or the head temperature at the time of scan completion, are made the target temperature of the temperature control of the next printing. As a result, in these head temperature controls there is a problem wherein head temperature variation is prone to become large.

SUMMARY OF THE INVENTION

An object of the present invention, by way of setting the target control temperature within a suitable range, is to provide an ink jet printing apparatus and temperature control method wherein head temperature does not rise excessively and density variation caused by head temperature variation can be inhibited.

In a first aspect of the present invention, there is provided an ink jet printing apparatus that scans a print head, provided with a plurality of ejection openings for ejecting ink, and performs printing on a print medium, said apparatus comprising: a head temperature acquisition unit that acquires a temperature of the print head; and a temperature control unit that, at a print head scan start time, changes the print head temperature to a target temperature, the target temperature being a temperature that differs only a predetermined temperature value from the print head temperature at a time when a scan before the print head scan start is completed, which is acquired by said head temperature acquisition unit.

In a second aspect of the present invention, there is provided a print head temperature control method, in an ink jet printing apparatus that scans a print head, provided with a plurality of ejection openings for ejecting ink, and performs printing on a print medium, said method comprising: a head temperature acquisition step that acquires a temperature of the print head; and a temperature control step that, at a print head scan start time, changes the print head temperature to a target temperature, the target temperature being a temperature that differs only a predetermined temperature value from the print head temperature at a time when a scan before the print head scan start is completed, which is acquired in said head temperature acquisition step.

According to the above configuration, it is possible to carry out printing within a suitable print head temperature range and with density variation inhibited, because at the time of scan start, temperature is controlled with a temperature, which is varied a predetermined value in reference to the head temperature at the time of print scan completion, as the target temperature.

Further features of the present invention will become apparent from the following description of exemplary embodiments (with reference to the attached drawings).

DESCRIPTION OF THE EMBODIMENTS

Embodiments of the present invention will be explained in detail below while making reference to the drawings.

Figure 1:
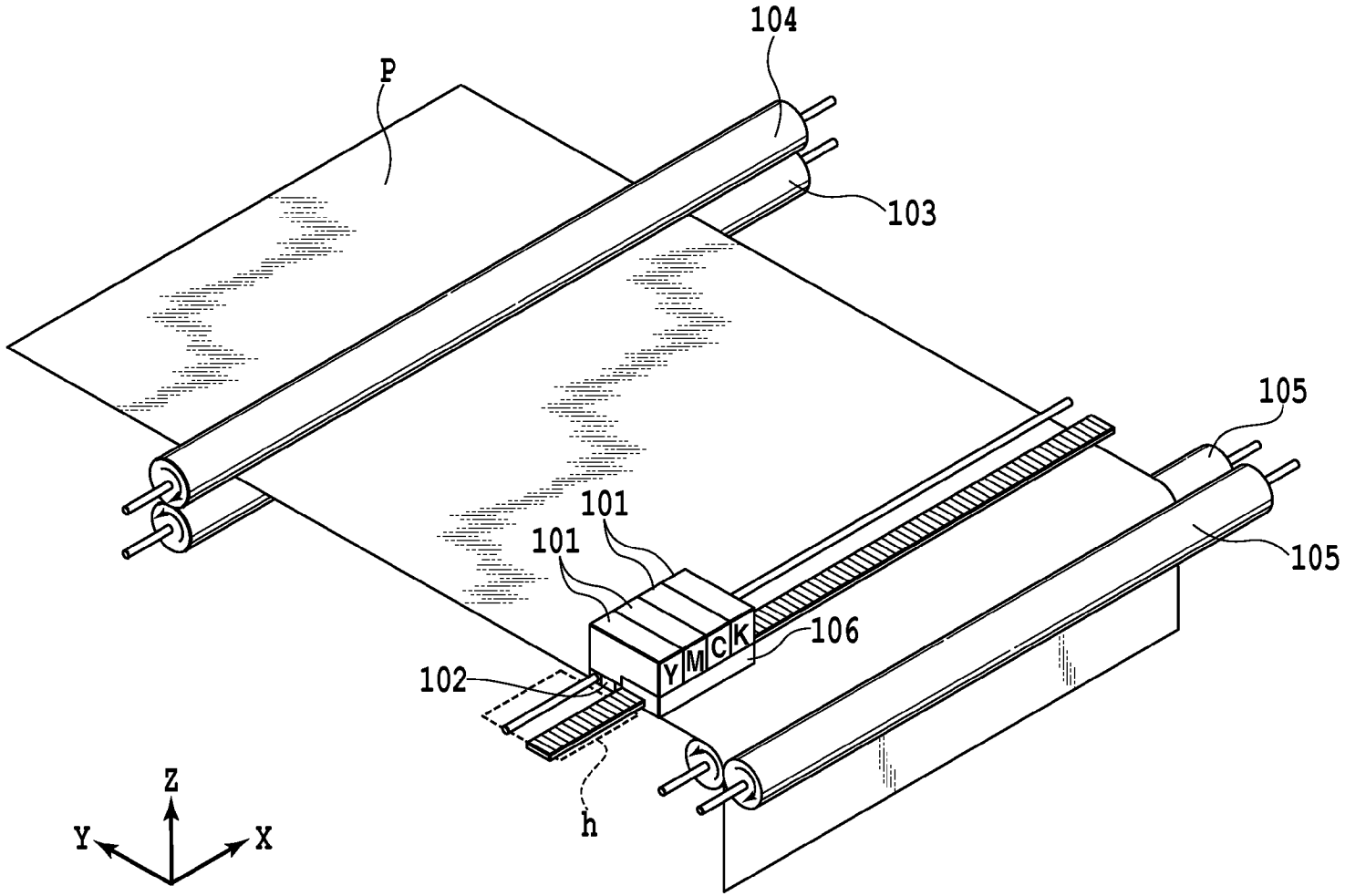
FIG. 1 is a diagram that illustrates a skeleton framework of the ink jet printing apparatus of an embodiment of the present invention.

FIG. 1 is a diagram illustrating the skeletal framework of the ink jet printing apparatus of an embodiment of the present invention. In the same figure a reference numeral 101 denotes ink tanks that respectively store black, cyan, magenta and yellow ink. On the lower side of the ink tanks in the figure, corresponding print heads 102 are connected, which eject the respective ink. Multiple ejection opening arrays (not shown) are provided on each ink print head 102. A reference numeral 103 denotes a paper feed roller, and rotates in the direction of the arrows while pinching the print medium P along with the auxiliary roller 104. The print medium P is accordingly conveyed in the Y direction of the figure. A reference numeral 105 also denotes a paper feed roller that, in the same manner as rollers 103 and 104, carry out feeding of the print medium P while pinching the print medium P. A reference numeral 106 denotes a carriage on which the above ink tanks and their connected print heads are mounted, and which can move in the X direction of the figure.

The carriage 106, which is at the location of the home position h at the print standby time, carries out scanning of the print head 102 while moving in the main scan direction, shown as the direction X on the diagram, when there is a command to start printing, and carries out printing during this scan by ejecting ink onto the print medium P from the multiple ejection openings of the print head. When the scan has finished advancing to the end of the print medium that is at a location on the opposite side of the home position, the carriage 106 returns to the original home position while the print medium P is conveyed a prescribed distance by the paper feed roller 103, for example, and scanning in the X direction is again repeated.

Figure 2:
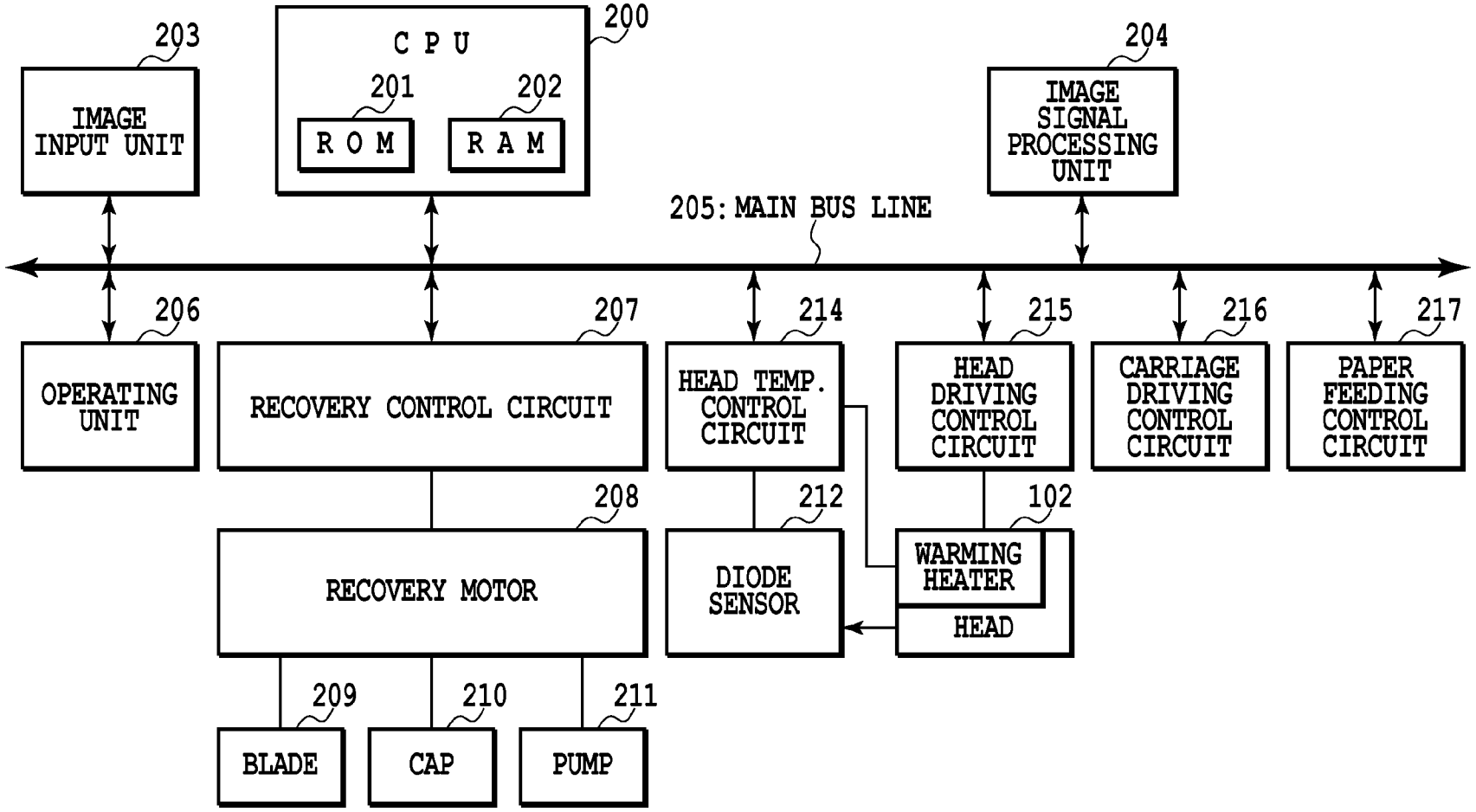
FIG. 2 is a block diagram illustrating the control structure of the ink jet printing apparatus shown in FIG. 1.

FIG. 2 is a block diagram that illustrates the control structure of the ink jet printing apparatus shown in FIG. 1. As shown in FIG. 2, the present control structure has an image input unit 203, a corresponding image signal processing unit 204 and a software processing unit such as a CPU 200, which respectively access the main bus line 205. The present control structure also has hard processing units such as an operating unit 206, a recovery control circuit 207, a head temperature control circuit 214, a head driving control circuit 215, a control circuit 216 driving the carriage in the main scan direction and a circuit 217 controlling paper feeding in the sub-scan direction. The CPU 200, utilizing the ROM 201 and the RAM 202, generates print data for driving the print head 102 based on image data input into the image input unit 203. Printing is then carried out by ejecting ink from the print head based on this print data. A program that executes a print head recovery timing chart is stored in advance in the RAM 202, and recovery conditions, such as preliminary ejection conditions, are provided, for example, to the recovery control circuit 207, the print head and the warming heater as necessary. The recovery motor 208 drives the print head and the oppositely spaced cleaning blade 209, cap 210 and absorption pump 211. When the above print head 102 is to be driven, the head driving control circuit 215 causes the print head 102 to be driven and ink to be ejected, based on print data.

Figure 3A:
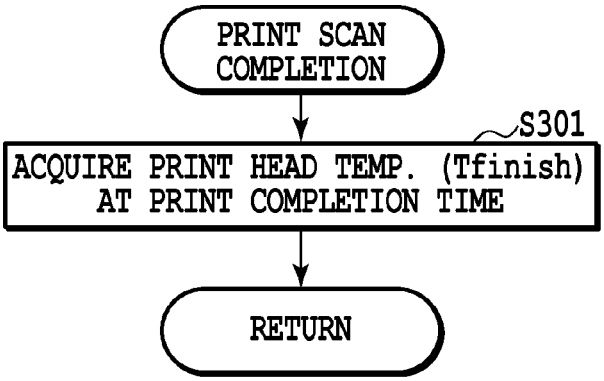
FIGS. 3A and 3B are flowcharts illustrating the print head temperature control of a first embodiment of the present invention.
Figure 3B:
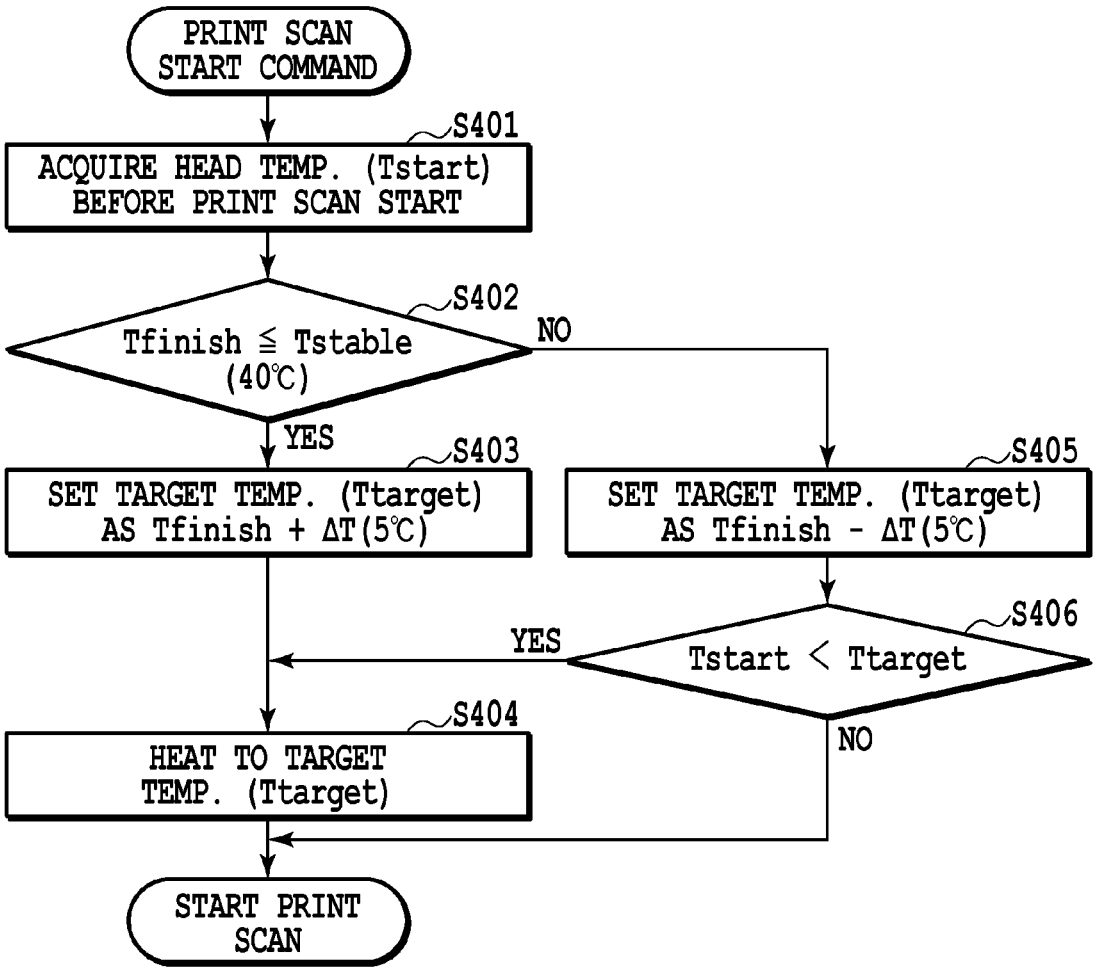

The CPU 200 executes the print head temperature control described, for example, in FIGS. 3A and 3B. In doing so, a pulse, of a degree insufficient to cause ejection, is applied to the electro-thermal converter (ejection heater) of the print head and the ink is heated. In a separate configuration a warming heater (sub-heater) is provided on the substrate on which an electro-thermal converter, used to eject ink of the print head 102, is provided, and it is possible to heat ink inside the print head by driving this heater. A diode sensor is also provided on the above substrate, and it is possible to measure the temperature of the actual ink inside the print head. Making use of this diode sensor 212 it is possible to acquire head temperatures at the time that a print scan is completed and before commencing a print scan, as described above. That is, the diode sensor 212 comprises a head temperature acquisition unit. It should be noted that the warming heater and the diode sensor 212 may be provided off the substrate, for example, they may be provided on members of the print head other than the substrate.

Several embodiments of the present invention will be described below, based on the above described apparatus structure. It should be noted that while the temperature control is described below as being carried out by respective print heads ejecting black, cyan, magenta and yellow ink, shown in FIG. 1, the applicability of the present invention is certainly not limited to this configuration. For example, it is also possible to apply the temperature control of the present invention to a single print head configured such that the respective ejection opening arrays, ejecting black, cyan, magenta and yellow ink, are integrated. In this case, for example, the detected print head temperature is due to the ejection of the above multiple ink types above.

First Embodiment

FIGS. 3A and 3B are flowcharts that illustrate the print head temperature control of a first embodiment of the present invention.

First, as shown in FIG. 3A, when one print head scan has been completed, at step 301 the head temperature control of the present embodiment acquires Tfinish, the head temperature at the print completion time.

Next, when there is a print scan start command relating to the next scan, the process shown in FIG. 3B is initiated, and first at step 401 Tstart, the head temperature at the time of print scan start, is acquired. Next, at step 402, it is determined if Tfinish, the acquired head temperature at the print scan completion time, is at or below Tstable, the stable ejection temperature of the print head of the present embodiment (at or below the first prescribed temperature). The stable ejection temperature Tstable is dependent on the structure of the print head, the type of ink, and the like, and is the temperature at which ink ejection is most stable. Let it be 40° C. in the present embodiment.

At step 402, if it has been determined that Tfinish, the head temperature at the print completion time, is equal to or lower than the stable ejection temperature Tstable, at step 403 the target temperature Ttarget is set as the print completion time head temperature Tfinish+ΔT. Next, at step 404, the head is heated to raise the head temperature to Ttarget and print scanning is started. It should be noted that in the present embodiment heating of the print head is carried out by applying an electric energy pulse, of a degree insufficient to cause ejection, to ejection heaters of the print head.

The above ΔT is the temperature where, in the case of printing by controlling the head temperature to Ttarget, where Ttarget is the target head temperature set utilizing ΔT, a density difference (density variation) between the print density of a print scan and the print density of a preceding print scan can not be substantively detected. Table 1 illustrates the relationship between ΔT of the present embodiment and the occurrence state of density variation (X: in the case where prominently detected, Δ: in the case where slightly detected, and O: in the case where substantively not detected).

TABLE 1

| | ΔT | | | | | | | | | |
|---|---|---|---|---|---|---|---|---|---|---|
| | At/Below 1° C. | 2° C. | 3° C. | 4° C. | 5° C. | 6° C. | 7° C. | 8° C. | 9° C. | At/Above 10° C. |
| Variation | ○ | ○ | ○ | ○ | ○ | Δ | Δ | X | X | X |

From the above table it can be seen that when ΔT is larger than 5° C. density variation occurs in the printed image. Therefore in the present embodiment ΔT is set at 5° C.

Referring again to FIG. 3B, when, at step 402, it is determined that Tfinish, the head temperature at the print completion time, is not equal to or not lower than the stable ejection temperature Tstable, at step 405 the target temperature Ttarget is set as the print completion time head temperature Tfinish−ΔT. Next, at step 406 it is determined whether Tstart, the temperature at the time of print scan start, is lower than the target temperature Ttarget.

If it is determined at step 406 that Tstart, the temperature at the time of print scan start, is lower than the target temperature Ttarget, at step 404 the head is heated to raise the head temperature to Ttarget, and the subsequent print scan is started. If it is determined at step 406 that Tstart, the temperature at the print scan start time, is not lower than the target temperature Ttarget, print scanning is started without the performance of heating.

Figure 4A:
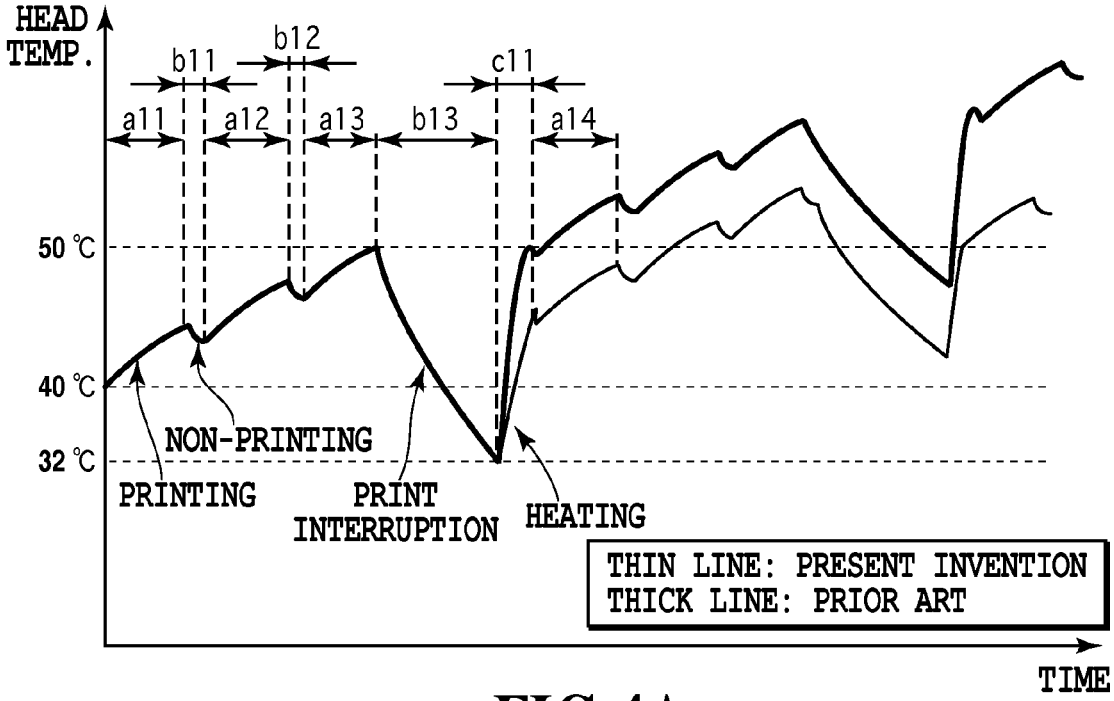
FIGS. 4A and 4B are diagrams respectively illustrating, during the printing of high and low print density images, head temperature variation versus the shift of time when there are print interruptions due to data transmission waiting time.

FIG. 4A is a diagram that illustrates head temperature variation versus the shift of time of a print head that has a head temperature of 40° C., which is the stable ejection temperature, when there is an interruption in printing due, for example, to data transmission waiting time during the printing of a high density image. In FIG. 4A the head temperature variation of the present embodiment is shown with a thin line, and the head temperature variation due to the prior art control described in Japanese Patent Application Laid-Open No. H04-193537 (1992) is shown with a thick line. The axy, bxy and cxy in the figure respectively denote time segments for print operation (scanning), non-print operation and heating.

The ejection frequency of a single scan becomes high due to printing a high print density image, and the increase of the head temperature becomes relatively large due to this print scanning. At the segment a11 the head temperature increases to 44° C. due to print scanning. Because of this, at step 301 shown in FIG. 3A 44° C. is acquired as the head temperature Tfinish at the print scan completion time.

Next, at the segment b11, return shifting of the print head to the scan start position is carried out and the head temperature drops 1° C. due to this non printing operation. Because of this, at step 401 shown in FIG. 3B, 43° C.=Tfinish (44° C.)−the temperature fall during the non-printing period (1° C.), is acquired as the head temperature Tstart at time of print scan start. Next, at step 402, it is determined that Tfinish (44° C.), the temperature at the print scan completion time, is not at or not below Tstable (40° C.), the stable ejection temperature. Next, at step 405, the target temperature Ttarget is set such that Ttarget=Tfinish (43° C.)−ΔT (5° C.)=38° C. However, at step 406, because it is determined that Tstart (43° C.), the print scan start temperature, is not lower than the target temperature Ttarget (38° C.), that is, because it is determined that it is above the target temperature, the print scan at the next segment a12 is started without performing heating.

The next print scans are subsequently carried out up to segments a12 to a13 without performing heating because, in the same manner as above, it is determined that Tstart, the temperature at the print start time, is not lower than the target temperature Ttarget.

At segment a13 the head temperature rises to 50° C. due to print scanning. Accordingly, at step 301 50° C. is acquired as Tfinish, the head temperature at the print scan completion time. After the printing operation at segment a13 has been completed, the next segment b13 is a non-printing region in which print operation is interrupted by way of, for example, data transmission waiting time. The relatively large print head temperature decreases due to this print interruption. Accordingly at step 401, 32° C. is acquired as Tstart, the head temperature before print head scan start. Next, at step 402, it is determined that the completion time temperature Tfinish (50° C.), acquired at the time that the print operation at segment a13 is completed, is higher than the stable ejection temperature Tstable (40° C.). Accordingly at step 405 the target temperature Ttarget is set at such that Ttarget=Tfinish (50° C.)−ΔT (5° C.)=45° C. Next, at step 406, it is determined that Tstart (32° C.), the temperature at the time of print scan start, is lower than the target temperature Ttarget (45° C.). Next, because it was determined that Tstart (32° C.), the temperature at the print scan start time, is lower than the target temperature Ttarget (45° C.), at step 404 heating is performed to the target temperature Ttarget (45° C.) at the heating segment c11, and print scanning of the next print segment a14 is commenced.

In this manner, after a print interruption due to, for example, waiting for data, the head temperature at the time of resuming printing becomes 45° C., a temperature that is 5° C. lower than the head temperature at the time of print interruption. The subsequent steps proceed along the same lines as the above sequence. In the above manner, in the present embodiment, even in the case where a high print density image is printed, it is possible to inhibit head temperature rise in comparison to the prior art.

Figure 4B:
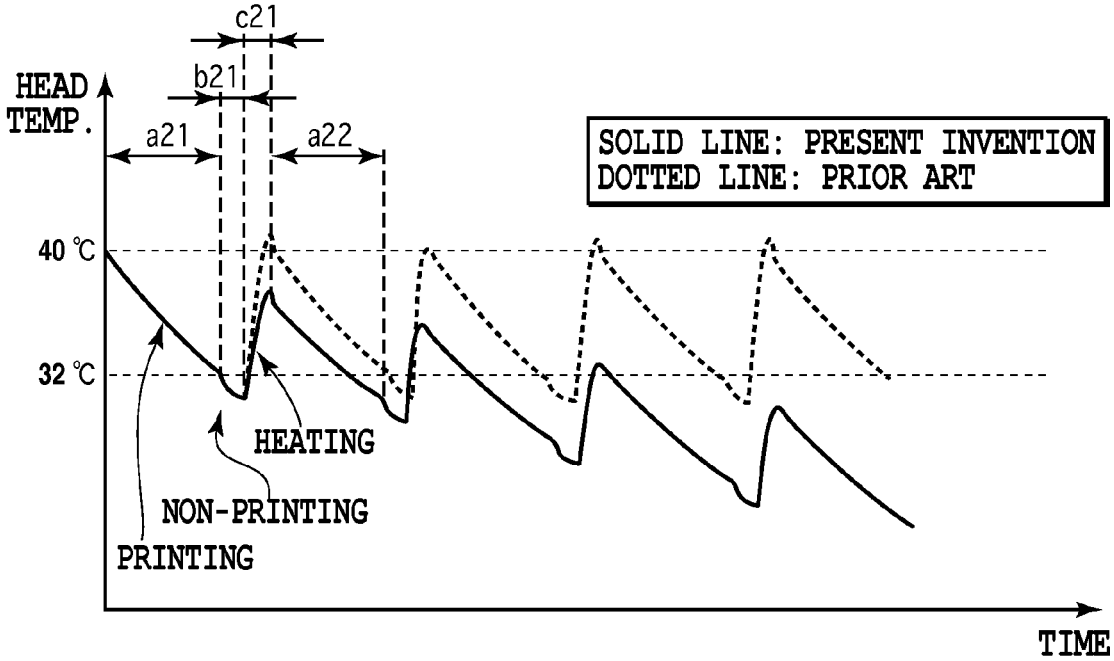

FIG. 4B is a diagram that illustrates head temperature variation versus the shift of time, when a print head that has a stable ejection head temperature of 40° C. prints a low print density image. In FIG. 4B the head temperature variation of the present embodiment is shown with a solid line, while the head temperature variation of the prior art temperature control described in Japanese Patent Application Laid-Open No. H08-039807 (1996) is shown with a dotted line.

Head temperature often falls during print scans wherein the ejection frequency of a single scan is lowered due to the printing of an image with a low print density. Head temperature becomes particularly prone to fall in the case of printing by dividing a single image into a plurality of scans, such as in so-called multi-pass printing, and in the case where scan speed is slow. It should be noted that in the figure reference signs axy, bxy and cxy carry the same meaning as in the example of FIG. 4A.

At the print segment a21 the head temperature drops to 32° C. due to print scanning. Accordingly, at step 301 shown in FIG. 3A 32° C. is acquired as Tfinish, the head temperature at the time of print scan completion.

Next, at the non-print operation segment b21, the direction of movement of the print head is reversed and it is returned to the print start position. Accordingly, at step 401 shown in FIG. 3B 31° C. is acquired as Tstart, the head temperature at the time of print scan start. Furthermore, at step 402 it is determined that Tfinish (32° C.), the temperature at the time of print scan completion, is lower than the stable ejection temperature Tstable (40° C.), and at step 403 the target temperature Ttarget is set such that Ttarget=Tfinish (32° C.)+ΔT (5° C.)=37° C.

Next, at the heating segment c21, heating up to 37° C., the target temperature Ttarget, is carried out at step 404, and the next print scan of the segment a22 is started. In this manner the head temperature difference between consecutive print scans is maintained at 5° C.=Ttarget−Tfinish, and therefore a print density difference (density variation) does not occur between scans. Subsequent steps proceed along the same lines as the above sequence.

As a result of the above, in the present embodiment, even in the case of printing an image with a low print density, in contrast to the prior art, it is possible to restrain the difference between the head temperature at the time of print scan completion and the head temperature at the time of print scan start to within 5° C., and prevent the occurrence of image variation.

According to the present embodiment, as above, when Tfinish, the head temperature at the time that the previous scan is completed, is higher than the stable ejection Temperature Tstable, the target temperature is set at a temperature that is only ΔT lower than the head temperature Tfinish. On the other hand, when Tfinish, the head temperature at the print completion time, is lower than the stable ejection temperature Tstable, the target temperature is set at a temperature that is only ΔT higher than the head temperature Tfinish. Accordingly in the case where an image with a high print density is printed, print head temperature increase can be inhibited. Also, because the difference between the head temperature at the time of print scan completion and the head temperature at the time of commencing the next print scan can be maintained within 5° C., the occurrence of print density variation between print scans can be prevented. It should be noted that the temperature that becomes the standard for determining whether Tfinish, the head temperature at the time of print completion, is high or low, is certainly not limited to the stable ejection temperature above. For example, in addition to the stable ejection temperature of the print head, it is also possible to take into consideration the density of heavily printed images, that is, to take into consideration the print head ejection frequency of the scans, when setting the temperature that will become the standard mentioned above. Again, as shown in the next embodiment, the standard for obtaining the target temperature is not limited temperatures.

Second Embodiment

In the first embodiment described above the target temperature was made to depend on the head temperature at the time of print scan completion. In contrast, in the second embodiment of the present invention, the target temperature is obtained by counting the number of print dots in one scan, and according to that value determining whether to add to or subtract the prescribed temperature ΔT from the head temperature at the time of print scan completion. That is, print dot count is information that relates to the print head temperature, and is the sum of the number of ink drops ejected in one scan of the print head from the plurality of ejection openings disposed on the print head. In other words, it is the sum of the number of ejections and corresponds to the ejection frequency of 1 scan. Thus this dot count unit is equivalent to the temperature information collection unit.

Figure 5A:
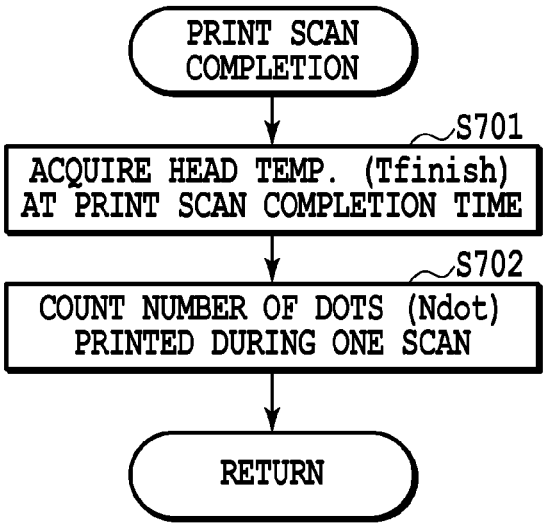
FIGS. 5A and 5B are flowcharts illustrating the print head temperature control of a second embodiment of the present invention.
Figure 5B:
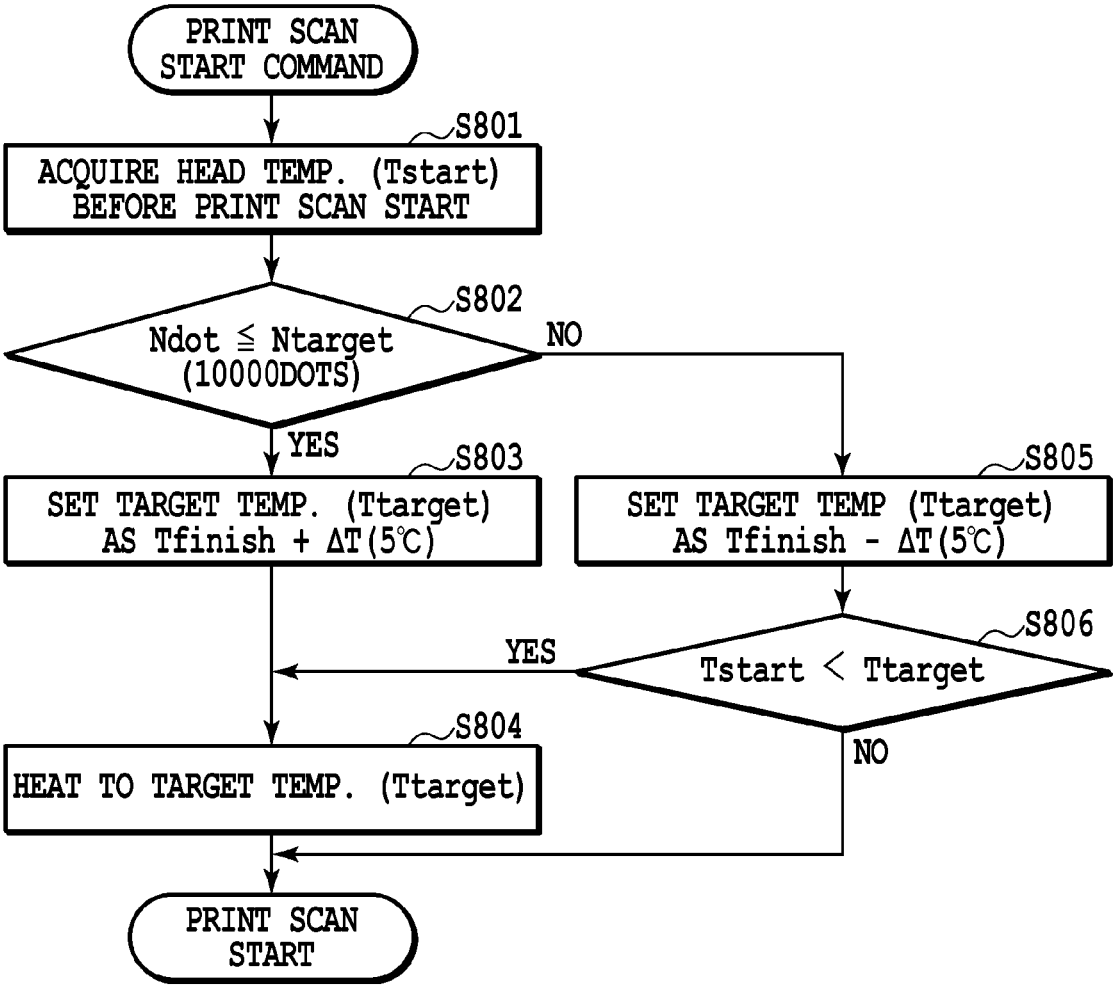

FIGS. 5A and 5B are flowcharts that illustrate print head temperature control according to a second embodiment of the present invention.

As shown in FIG. 5A, when one scan is completed the present process is initiated, and at step 701 Tfinish, the head temperature at the time of print scan completion, is acquired. Next, at step 702, the number of dots (Ndot), which were printed in the single scan before the present process was initiated, are counted and the present process is completed.

Next, at the time the scan subsequent to the above scan is commenced, the process illustrated in FIG. 5B is executed. That is, when there is a print scan start command and the present process is initiated, first, at step 801, Tstart, the head temperature at the time print scanning is commenced, is acquired.

Next, at step 802, it is determined whether or not the number of dots (Ndot), counted at the time of print scan completion, are less than the prescribed threshold value Ntarget. This threshold value Ntarget is dependent on the structure of the print head and the ambient temperature and is the number of dots wherein it is just possible to print without the occurrence of a temperature change in a single scan, when commencing a print scan from the target temperature at which ejection is stable. Table 2 illustrates the relationship, in the present embodiment, between the number of dots printed in one scan and head temperature variation, when commencing a print scan from the target temperature.

TABLE 2

| Temp. Change | −4 | −3 | −2 | −1 | 0 | 1 | 2 | 3 | 4 | 5 |
|---|---|---|---|---|---|---|---|---|---|---|
| Printed Dot Count | 2000 | 4000 | 6000 | 8000 | 10000 | 12000 | 14000 | 16000 | 18000 | 20000 |

From Table 2 Ntarget, the threshold value of the present invention, is set at 10,000 dots.

Again referring to FIG. 5B, when it is determined at step 802 that the count value Ndot is lower (a prescribed value lower) than the threshold value Ntarget (10,000 dots), at step 803 the target temperature Ttarget is set to equal Tfinish+ΔT. Here, ΔT is the same value as in the first embodiment. Next, at step 804, the print head is heated raising the temperature to Ttarget and the subsequent print scan is commenced.

At step 802 when it is determined that the count value Ndot is not lower than the threshold value Ntarget (10,000 dots), at step 805 the target temperature is set to equal Tfinish−ΔT. Next, at step 806, it is determined whether or not Tstart, the temperature at the time of print scan start, is lower than the target temperature Ttarget.

At step 806 when it is determined that Tstart, the temperature at the time of print scan start, is lower than the target temperature Ttarget, the head is heated raising the temperature to Ttarget and the subsequent print scan is commenced. At step 806 when it is determined that Tstart, the temperature at the time of print scan start, is not lower than the target temperature Ttarget, print scanning is commenced without heating.

In the head temperature control of the above present embodiment, head temperature variation versus time presents itself as similar to the variation of the first embodiment shown in FIGS. 4A and 4B. In the first embodiment, when printing of the print regions a11, a12, and a13 of FIG. 4A, showing an example of printing a high density image, is commenced, at step 402 of FIG. 3B a determination is always performed as to whether Tfinish, the temperature at the time of print scan completion, is lower than the stable ejection temperature Tstable. In substitution of this determination, in the present embodiment, when printing a high density image and commencing printing of the same print regions, at step 802, a determination is always performed as to whether the count value Ndot is lower than the threshold Ntarget. Because the subsequent processes are the same as the first embodiment, head temperature variation versus time presents itself in the same manner as the first embodiment.

Again, also in FIG. 4B where a low density image is printed, as there is a determination opposite from the case of high density, head temperature variation versus time of the present embodiment also presents itself in the same manner as the first embodiment. Thus in the present embodiment it is possible to obtain the same effect as in embodiment 1.

Third Embodiment

In a third embodiment of the present invention, in addition to the temperature control of the first embodiment, the print head is heated raising the temperature to the stable ejection temperature before carrying out printing on a new print medium. A fixed amount of time, due to paper ejection, feeding, etc., is commonly required to start printing on a new print medium subsequent to the completion of printing on 1 sheet of a print medium. Therefore the head temperature often drops according to the relationship among the ambient temperature and the length of time until commencing printing on the new print medium.

Figure 6:
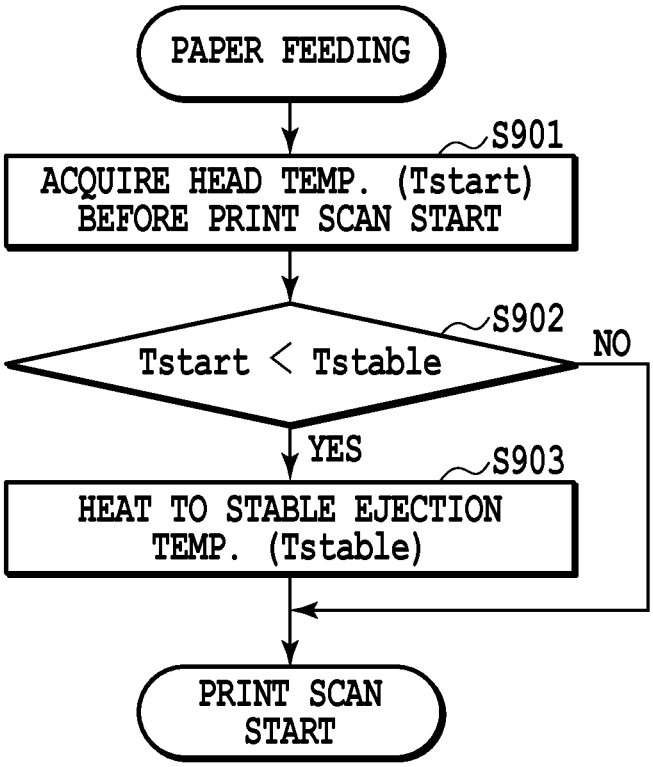
FIG. 6 is a flowchart illustrating the head temperature control of a third embodiment of the present invention, which is implemented when a new print medium is fed.

FIG. 6 is a flowchart illustrating the head temperature control executed when a new print medium is fed, in accordance with a third embodiment of the present invention.

When print medium feeding is executed the present process is initiated, Tstart, the head temperature at the time of print scan start is first acquired at step 901. Next, at step 902, it is determined whether or not Tstart, the temperature at the print scan start time, is lower than the stable ejection temperature Tstable.

At step 902, when it is determined that Tstart, the temperature at the print scan start time, is lower than the stable ejection temperature Tstable, at step 903 the print head is heated to the stable ejection temperature Tstable (the second prescribed temperature) and print scanning is subsequently commenced. On the other hand, at step 902, when it is determined that Tstart, the temperature at the print scan start time, is not lower than the stable ejection temperature Tstable, print scanning is commenced without heating.

Figure 7:
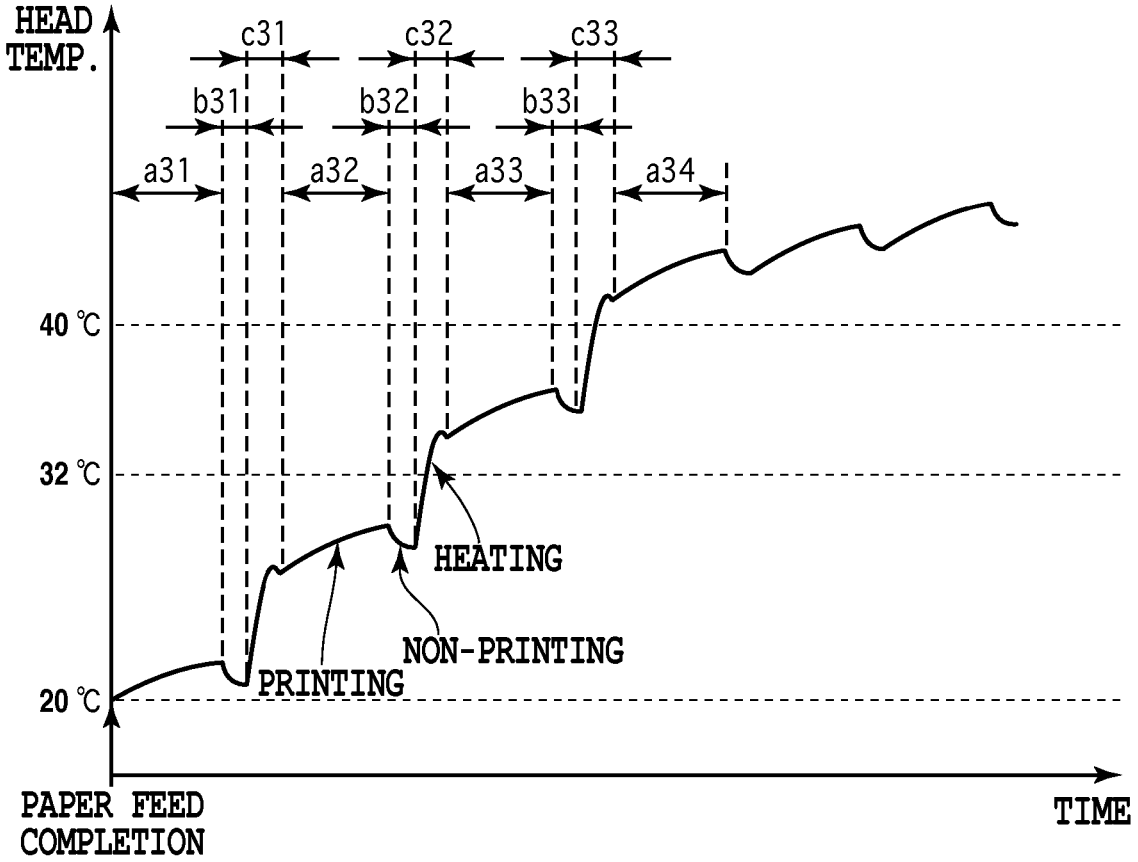
FIG. 7 is a diagram that illustrates, for comparison, head temperature variation in the case where the control of the first embodiment illustrated in FIGS. 3A and 3B is executed, but upon feeding the temperature control illustrated in FIG. 6 is not executed.

FIG. 7 is diagram that illustrates, for the purpose of comparison, head temperature variation in the case where the control according to the first embodiment, shown in FIGS. 3A and 3B, is executed, but without performing the temperature control shown in FIG. 6 when feeding paper. The example shown in FIG. 7 illustrates an example where at the time of paper feeding the head temperature falls to the ambient temperature 20° C. Again, in the figure, axy, bxy and cxy carry the same meaning as those of the first embodiment, illustrated in FIGS. 4A and 4B.

After carrying out the feeding of a print medium, at print operation segment a31, the head temperature rises to 22° C. due to the print scan. Accordingly, 22° C. is acquired as Tfinish, the head temperature at the time of print scan completion. Next, at the non-print segment b31, the direction of print head movement is reversed and the print head returns to the original scan start position, and the head temperature falls 1 degree due to the non-printing time. Accordingly, Tstart, the head temperature at the time of print scan start, is acquired as 21° C.=Tfinish (22° C.), the temperature at the time of print scan completion−the temperature fallen during the non-printing interval (1° C.). Subsequently, it is determined that Tfinish, the temperature at the time of print scan completion (22° C.), is lower than the stable ejection Temperature Tstable (40° C.), and the target temperature is set at 27° C.=Tfinish (22° C.)+ΔT (5° C.). Accordingly at the heating region 31, heating is performed to the target temperature Ttarget 27° C., and the next print scan a32 is commenced. The same process as that of the above regions a31 to c31 is repeated up through segment c33. By way of the process at the above regions a31 to c31 having been repeated 3 times in this manner, the head temperature surpasses the stable ejection temperature 40° C., and from segment a34 the head temperature variation becomes as that of the series of temperature variations of the first embodiment shown in FIG. 4A.

As above, in the first embodiment where head temperature control at the time of paper feeding is not executed, it is only possible to heat ΔT (5° C.) from the standpoint of image variation. As a result, when feeding paper where the difference between the head temperature and the stable ejection temperature is large, it is necessary to repeatedly perform a number of print scans until the stable ejection temperature is exceeded. In this case, depending on the structure of the print head and type of ink, etc., the ejection may not stabilize in the few scans up to where the stable ejection temperature has been reached. Also, although it is possible to prevent the occurrence of density variation that arises between adjacent print scans, there may be a gradual color change between the front half of the print region and the latter half of the print region of an image printed by multiple print scans.

Figure 8:
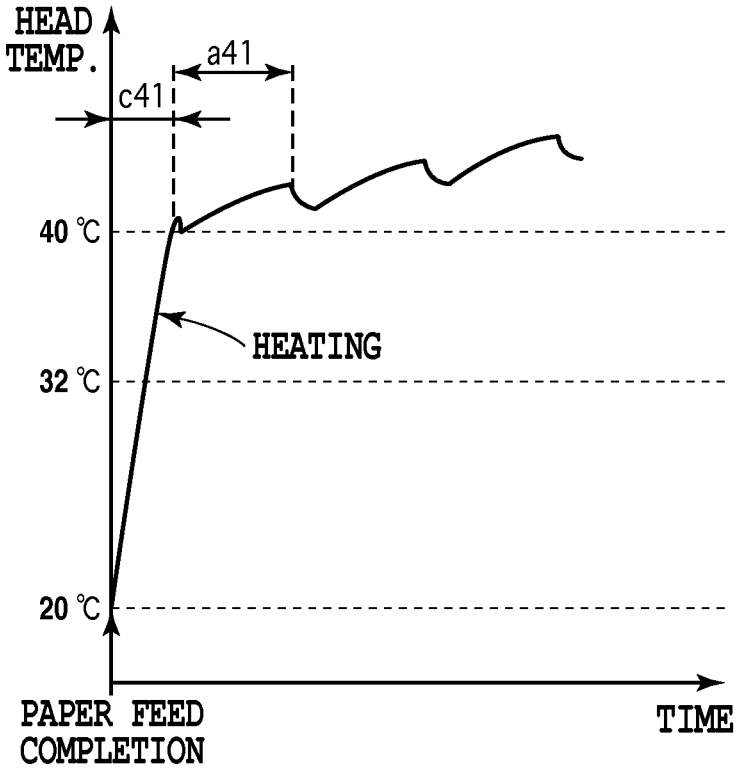
FIG. 8 is a diagram that illustrates head temperature variation versus the passage of time, in a third embodiment of the present invention.

FIG. 8 is a diagram that illustrates head temperature variation versus the passage of time, according to a third embodiment of the present invention. In the same manner as the example shown in FIG. 7, an example is shown where the head temperature declines to the ambient temperature 20° C. at the time of paper feeding. Again, in the figure axy and cxy carry the same meaning as in the first embodiment.

In accordance with the control shown in FIG. 6, after feeding of the print medium has been performed, 20° C. is acquired as Tstart, the head temperature at the time of print scan start. Furthermore, it is determined that Tstart, the head temperature at the time of print start (20° C.), is lower that the stable ejection temperature Tstable (40° C.), heating of the print head is performed raising the temperature to the stable ejection temperature Tstable (40° C.), and the next print scan a41 is commenced. The subsequent series of temperature variations presents itself as that of the first embodiment.

In the present embodiment normal printing is carried out as in the manner above, after heating up to the stable ejection temperature 40° C. before the first print scan on a newly fed print medium. Because of this, with respect to head configurations and ink types in which the ejection state is easily influenced by the head temperature, it is possible to avoid carrying out print scans at a temperature at which ejection would be unstable, thus stabilizing ejection. Herewith it is possible to print images with reduced density variation between the front region and the latter region of an image printed by multiple print scans.

Fourth Embodiment

A fourth embodiment of the present invention, in addition to the head temperature control according to the first embodiment, is related to the performance of temperature control that, during print scanning, maintains print head temperature at a prescribed temperature (3rd prescribed temperature) that is higher than ambient temperature. A warming heater provided near the ejection openings of the print head and for warming ink in the vicinity of the ejection openings, and an apparatus that imparts heat energy, which does not induce ejection, to the heater of the ejection openings not used in printing, are provided as means to maintain print head temperature during scanning. In the present embodiment any type of temperature maintenance means may be employed.

The temperature control of the present embodiment, at the time of print scan completion, is the same as FIG. 3A of the first embodiment, and Tfinish, the head temperature at the time of the print scan completion is acquired.

Figure 9:
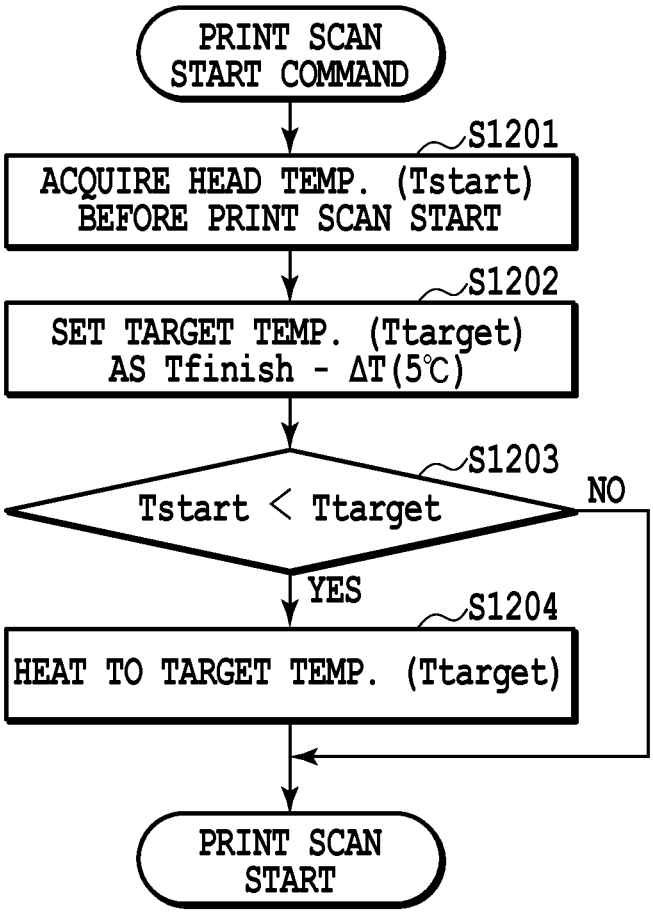
FIG. 9 is a flowchart illustrating head temperature control at the time of start of a print scan of a 4th embodiment of the present invention.

FIG. 9 is a flowchart that illustrates head temperature control, at the time of print scan start, according to a fourth embodiment of the present invention. In the present embodiment, as described above, there is not a print head temperature decrease, even in the case of printing an image with a low print density, because maintenance of the head temperature is carried out during scanning. That is, in accordance with the temperature control of the present embodiment, regardless of the density of the printed image, temperature variation such as that of the first embodiment shown in FIG. 4A is exhibited. The temperature control of the present embodiment, which implements this temperature variation, is illustrated in FIG. 9.

FIG. 9 is a flowchart that illustrates head temperature control according to a fourth embodiment of the present invention.

When there is a print scan start command the present process is initiated and Tstart, the head temperature at the print scan start time is first acquired at step 1201. Next at step 1202, the target temperature Ttarget is set as Tfinish−ΔT. ΔT is a value similar to that described in the first embodiment. Next, at step 1203, it is determined whether or not Tstart, the head temperature at the print scan start time, is lower than the target temperature Ttarget.

When it is determined at step 1203 that Tstart, the head temperature at the print scan start time, is lower than the target temperature Ttarget, at step 1204 the head is heated until its temperature reaches the target temperature Ttarget, and print scanning is commenced. On the other hand, when it is determined at step 1203 that Tstart, the head temperature at the print scan start time, is not lower than the target temperature Ttarget, print scanning is commenced without carrying out heating.

In accordance with the present embodiment above, during printing, because heat energy is added in order to maintain temperature, the head temperature always exhibits a change upwards due to print scanning, regardless of the density of the printed image and in the same manner as shown in FIG. 4A. Again, during printing, because heat energy is added in order to maintain temperature, the head temperature increase of one print scan shown in FIG. 4A further increases, and the effect of the present invention becomes easier to obtain.

It is also possible to combine the present embodiment with the temperature control described in relation to the third embodiment, which heats the print head temperature up to the stable ejection temperature at the time of carrying out the feeding of a new print medium. This allows a print scan with a head temperature that would make ejection unstable after paper feeding not to be performed but a print scan with a head temperature that would make ejection stable to be performed and therefore reduces density variation between the front half and the latter half of the plurality of scans.

Fifth Embodiment

A fifth embodiment of the present embodiment relates to a head temperature control that utilizes a cooling mechanism that lowers print head temperature, and employs a cooling fan as the cooling mechanism. The control of the present embodiment, at the time of print scan completion, is the same as FIG. 3A relating to the first embodiment, and Tfinish, the head temperature at the time of the print scan completion is acquired.

Figure 10:
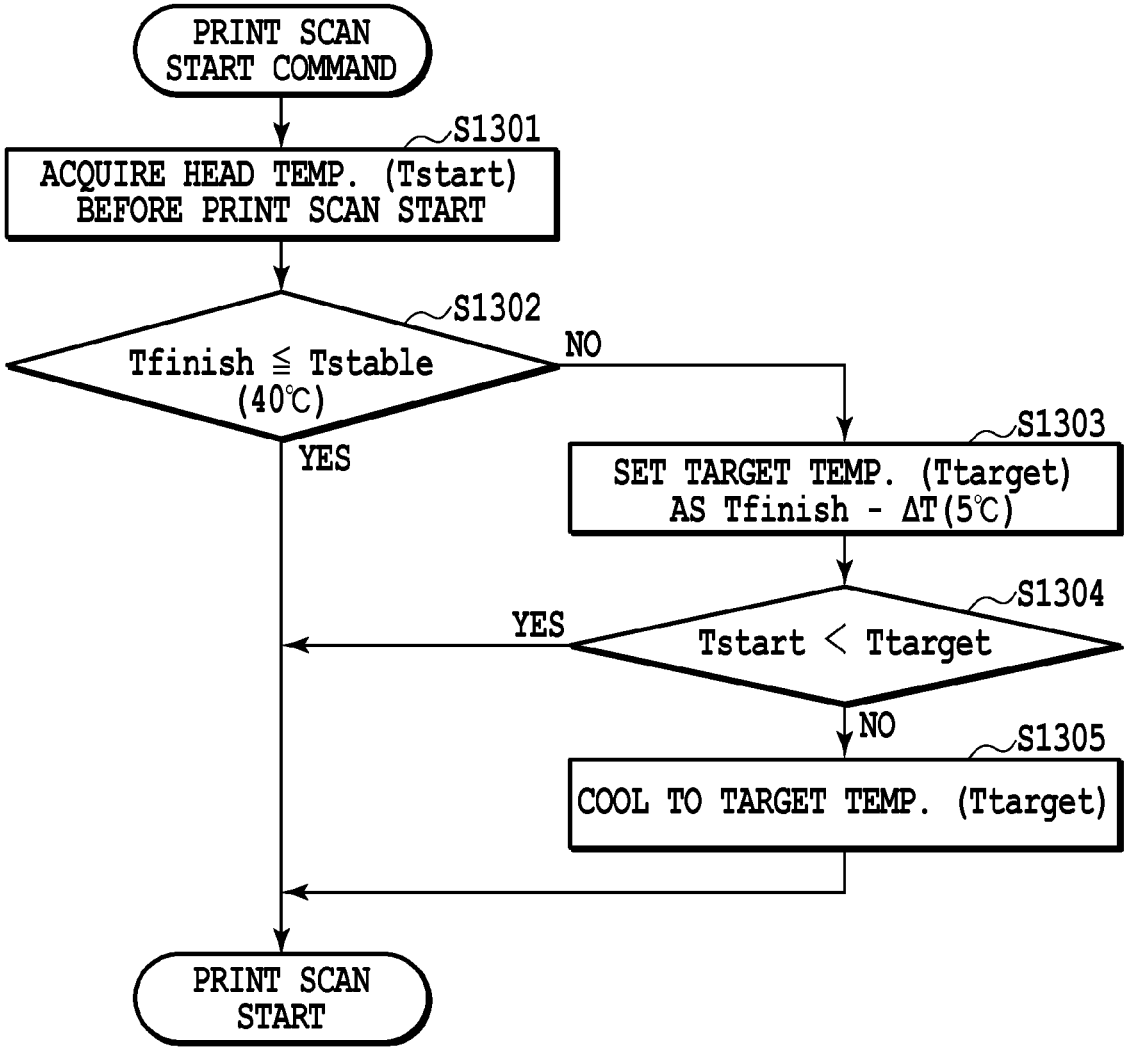
FIG. 10 is a flowchart illustrating the head temperature control process of a 5th embodiment of the present invention.

FIG. 10 is a flowchart that illustrates a head temperature control process according to a fifth embodiment of the present invention.

When a print scan start command is issued, Tstart, the head temperature at the print scan start time, is acquired at step 1301. Next, at step 1302, it is determined whether or not Tfinish, the head temperature at the time of print scan completion, is lower than the stable ejection temperature Tstable.

When it is determined that Tfinish, the temperature at the print scan start time, is at or lower than the stable ejection temperature Tstable, print scanning is commenced. On the other hand, when it is determined that Tfinish, the temperature at the print scan start time, is not at or lower than the stable ejection temperature Tstable, at step 1303 the target temperature Ttarget is set as Tfinish−ΔT° C. Here, the value of ΔT is the same 5° C. as that of the first embodiment.

Next, at step 1304, it is determined whether or not Tstart, the temperature at the print start time, is lower than the stable ejection temperature Ttarget. When it is determined that Tstart, the temperature at the print start time, is lower than the stable ejection temperature Ttarget, printing is commenced. On the other hand, when it is determined that Tstart, the temperature at the print start time, is not lower than the stable ejection temperature Ttarget, at step 305, making use of a cooling fan, the head is cooled to the target temperature Ttarget, and subsequently print scanning is commenced.

Figure 11:
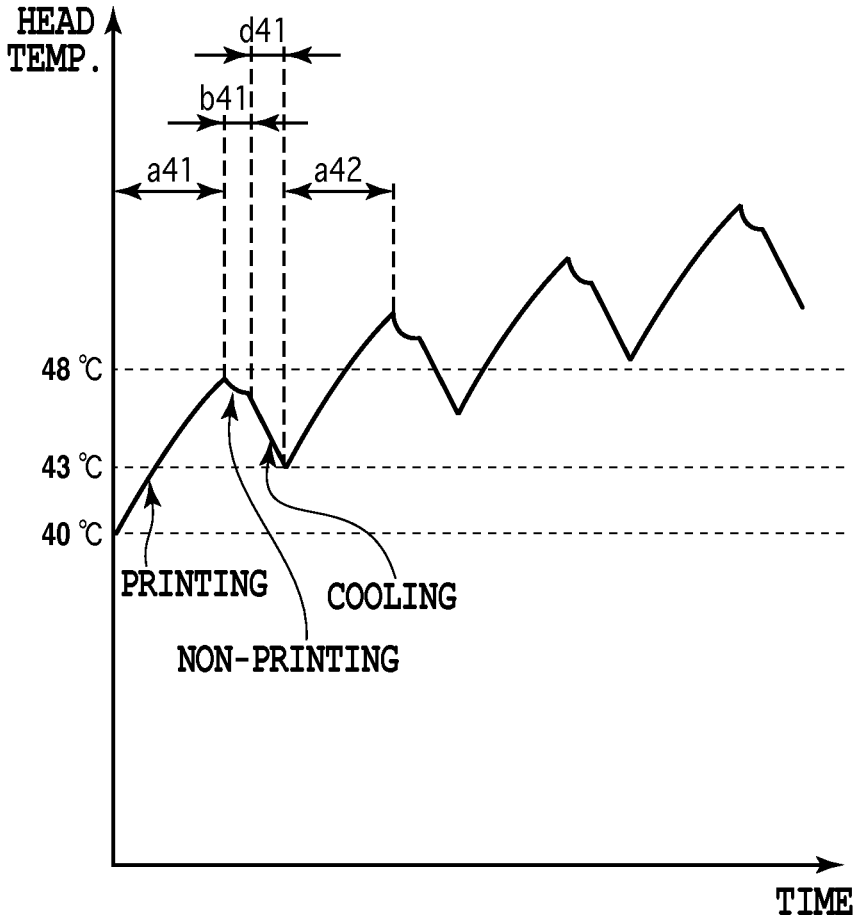
FIG. 11 is a diagram that illustrates head temperature variation due to the temperature control of a 5th embodiment.

FIG. 11 is a diagram that illustrates head temperature variation according to the temperature control of the present embodiment. The axy, bxy and dxy in the figure respectively denote time segments for print scanning, non-printing and cooling.

At the print segment a41, the head temperature increases to 48° C. due to print scanning, and accordingly at step 301 48° C. is acquired as Tfinish, the head temperature at the print scan completion time. Next, at the non-print operation segment b41, the direction of movement of the print head is reversed, a return movement to the position of scan start is carried out, and the head temperature drops 1° C. because of the non-print operation. Accordingly, at step 1301, 47° C.=Tfinish (48° C.)−the temperature fall during the non-printing period (1° C.), is acquired as Tstart, the head temperature at the print scan start time. Subsequently at step 1302 it is determined that Tfinish (48° C.), the head temperature at the print scan completion time, is not lower than the stable ejection temperature Tstable (40° C.), and at step 1303 the target temperature Target is set such that Ttarget=Tfinish (48° C.)−ΔT (5° C.)=43° C. Next at step 1304 it is determined that Tstart (47° C.), the temperature at the print scan start time, is not lower than the target temperature Ttarget (43° C.), and at step 1305 the cooling fan is driven and the head temperature is cooled to Ttarget. Next, print scanning of the next print scan segment a42 is commenced. The same process is subsequently repeated.

Figure 12A:
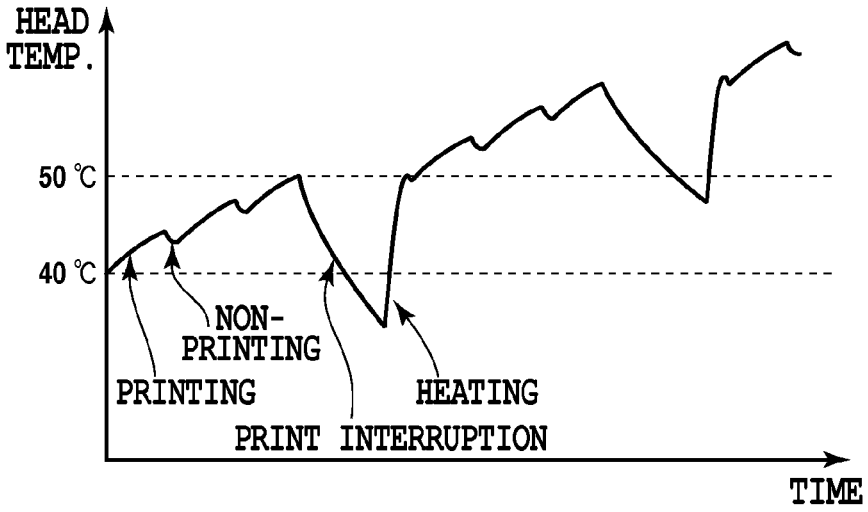
FIG. 12A is a diagram illustrating head temperature variation when there is a print interruption during the printing of a high density image, in the temperature control of Japanese Patent Application Laid-Open No. H04-193537 (1992), and FIGS. 12B and 12C respectively illustrate head temperature variation when low and high print density images are printed, in the temperature control of Japanese Patent Application Laid-Open No. H08-039807 (1996).
Figure 12B:
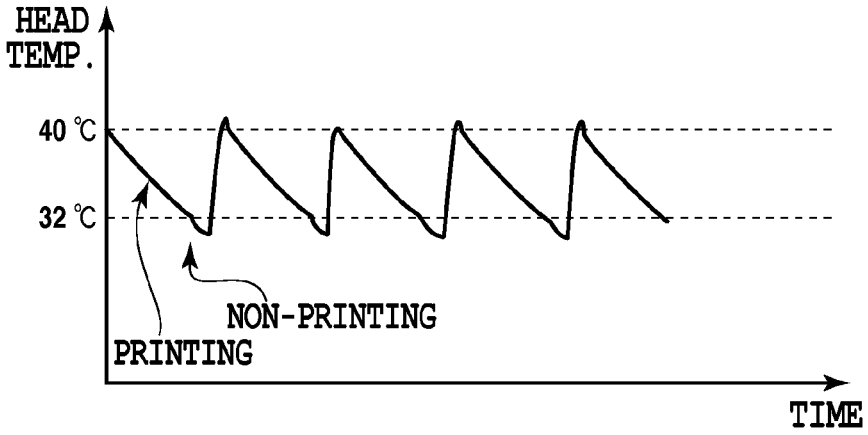
Figure 12C:
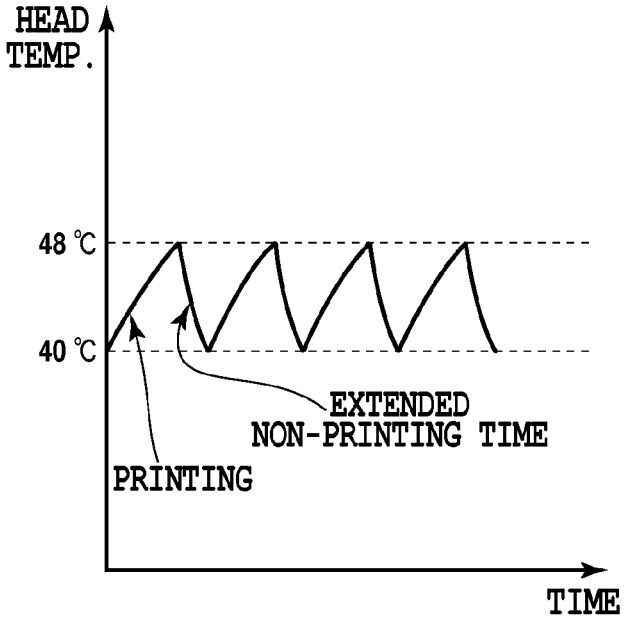

Previously, in the case where head temperature greatly increased due to print scanning, lengthening of the non-printing time and lowering of the head temperature down to the vicinity of the stable ejection temperature were carried out, as shown in FIG. 12C. Thus, as a result of this, the difference between the head temperature at the time of print scan completion and the time of print scan start became large and density variation occurred. Also, density variation occurred even in the case of making use of a cooling fan and cooling the head down to the stable ejection temperature between scans.

In contrast, according to the fifth embodiment above, the target temperature is made a temperature that is only a prescribed amount ΔT lower than the head temperature at the print scan completion time, even in the case where the head temperature increases by a large margin due to print scanning. Because of this, it is possible to keep the difference between the head temperature at the time of print scan completion and the time of print scan start within ΔT, and it is possible to reduce density variation between the images printed by each scan.

While the preset invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-235329, filed Oct. 9, 2009, which is hereby incorporated by reference herein in its entirety.

What is claimed is:

1. An ink jet printing apparatus, comprising:

a print head that includes at least one ejection opening for ejecting ink onto a print medium to perform printing;

a head temperature acquisition unit configured to acquire information on a temperature of said print head; and a temperature control unit configured to (i) set a target temperature based on a temperature of said print head at a time when an immediately preceding scan is completed, and (ii) change the temperature of said print head so that the temperature of said print head becomes the target temperature at a start of a next scan to be performed, wherein said temperature control unit is further configured to set the target temperature to be lower by a predetermined amount than the temperature of said print head at the time when the immediately preceding scan is completed, so as to reduce a temperature increase of said print head, in a case where the temperature of said print head, shown by the information acquired by said head temperature acquisition unit at the time when the immediately preceding scan is completed, is higher than a stable temperature of said print head.

2. The ink jet printing apparatus according to claim 1, wherein said temperature control unit is further configured to set the target temperature to be higher by a predetermined amount than the temperature of said print head at the time when the immediately preceding scan is completed, in a case where the temperature of said print head, shown by the information acquired by said head temperature acquisition unit at the time when the immediately preceding scan is completed, is equal to or lower than a stable temperature of said print head.

3. The ink jet printing apparatus according to claim 1, wherein said head temperature acquisition unit acquires a number of ejections from said print head in the immediately preceding scan as the information.

4. The ink jet printing apparatus according to claim 1, wherein said temperature control unit is further configured to change the temperature of said print head to be the target temperature of said print head when the print medium is fed.

5. The ink jet printing apparatus according to claim 1, wherein said temperature control unit is further configured to maintain the temperature of said print head at a temperature that is higher than an ambient temperature, when a scan of the print medium is performed.

6. The ink jet printing apparatus according to claim 1, wherein said temperature control unit is further configured to perform heating of said print head so as to cause the temperature of said print head to be the target temperature at the start of the next scan to be performed, in a case where the temperature of said print head, shown by the information acquired by said head temperature acquisition unit before the start of the next scan to be performed, is lower than the target temperature, and wherein said temperature control unit is further configured to not perform heating of said print head, in a case where the temperature of said print head, shown by the information acquired by said head temperature acquisition unit before the start of the next scan to be performed, is equal to or higher than the target temperature.

7. The ink jet printing apparatus according to claim 1, wherein said print head further comprises a plurality of heaters configured to generate heat for ejecting ink and respectively corresponding to a plurality of ejection openings, and wherein said temperature control unit is further configured to change the temperature of said print head by causing the plurality of heaters to generate heat that is not enough to eject ink.

8. The ink jet printing apparatus according to claim 1, wherein said print head further comprises a plurality of heaters configured to generate heat for ejecting ink and respectively corresponding to a plurality of ejection openings, and a sub-heater configured to adjust a temperature of the ink.

9. A print head temperature control method for an ink jet printing apparatus that includes a print head provided with at least one ejection opening for ejecting ink onto a print medium, said method comprising:

a temperature acquisition step of acquiring information on a temperature of the print head; and a temperature control step of (i) setting a target temperature based on a temperature of the print head at a time when an immediately preceding scan is completed, and (ii) changing the temperature of the print head so that the temperature of the print head becomes the target temperature at a start of a next scan to be performed, wherein the target temperature is set, in said temperature control step, to be lower by a predetermined amount than the temperature of the print head at the time when the immediately preceding scan is completed, so as to reduce a temperature increase of the print head, in a case where the temperature of the print head, shown by the information acquired in said temperature acquisition step at the time when the immediately preceding scan is completed, is higher than a stable temperature of the print head.

10. The print head temperature control method according to claim 9, wherein the target temperature is set, in said temperature control step, to be higher by a predetermined amount than the temperature of the print head at the time when the immediately preceding scan is completed, in a case where the temperature of the print head, shown by the information acquired in said temperature acquisition step at the time when the immediately preceding scan is completed, is equal to or lower than a stable temperature of the print head.

11. The print head temperature control method according to claim 9, wherein a number of ejections from the print head in the immediately preceding scan is acquired, in said temperature acquisition step, as the information.

12. The print head temperature control method according to claim 9, wherein the temperature of the print head is changed, in said temperature control step, to be the target temperature when the print medium is fed.

13. The print head temperature control method according to claim 9, wherein said temperature control step further comprises maintaining the temperature of the print head at a temperature that is higher than an ambient temperature, when a scan of the print medium is performed.

14. The print head temperature control method according to claim 9, wherein the print head is heated, in said temperature control step, so as to cause the temperature of the print head to be the target temperature at the start of the next scan to be performed, in a case where the temperature of the print head, shown by the information acquired in said temperature acquisition step before the start of the next scan to be performed, is lower than the target temperature, and wherein heating of the print head is not performed in said temperature control step, in a case where the temperature of the print head, shown by the information acquired in said temperature acquisition step before the start of the next scan to be performed, is equal to or higher than the target temperature.

15. The print head temperature control method according to claim 9, wherein said temperature control step changes the temperature of the print head by causing a plurality of heaters, included in the print head and respectively corresponding to a plurality of ejection openings, to generate heat that is not enough to eject ink.

* * * * *